US005609277A

United States Patent [19]

McDonald

[11] Patent Number: 5,609,277

[45] Date of Patent: Mar. 11, 1997

[54] INSULATING SLEEVE AND BEVERAGE CAN HOLDER

[76] Inventor: Anthony P. McDonald, 12 Warrenton Ct., Huntington, N.Y. 11743

[21] Appl. No.: 502,383

[22] Filed: Jul. 14, 1995

[51] Int. Cl.[6] ..... A45F 3/18

[52] U.S. Cl. ..... 224/148.3; 224/148.1; 224/148.4; 224/148.7; 220/903

[58] Field of Search ..... 224/148.1, 148.2, 224/148.3, 148.4, 148.7; 220/903, 906, 710.5, 711, 715, 739, 740

[56] References Cited

U.S. PATENT DOCUMENTS

| | | | |
|---|---|---|---|
| 1,177,562 | 3/1916 | Amato et al. | 220/740 |
| 4,872,577 | 10/1989 | Smith | 220/903 |
| 4,927,047 | 5/1990 | Stuber et al. | 220/903 |
| 5,048,734 | 9/1991 | Long | 220/903 |
| 5,222,623 | 6/1993 | Eger et al. | 220/715 |

*Primary Examiner*—Henry J. Recla
*Assistant Examiner*—Kam Shah

[57] ABSTRACT

A holder for enclosing and supporting a beverage can residing within an insulating sleeve. The holder includes a cylindrical container for receiving an insulating sleeve having a beverage can positioned therein. A lid is movably mounted over an upper end of the container and can be closed to seal the beverage can within the container and reduce a loss of dissolved carbon dioxide from a beverage in the can. Belt clips and a mounting projection extend from the container for securing to a belt or other support surface.

18 Claims, 4 Drawing Sheets

INSULATING SLEEVE AND BEVERAGE CAN HOLDER

BACKGROUND OF THE INVENTION

1. Field of the Invention

The present invention relates to container support structures and more particularly pertains to an insulating sleeve and beverage can holder for enclosing and supporting a beverage can residing within an insulating sleeve.

2. Description of the Prior Art

The use of container support structures is known in the prior art. More specifically, container support structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art container support structures include U.S. Pat. No. 5,261,554; U.S. Pat. No. 4,708,273; U.S. Pat. No. 4,620,426; U.S. Pat. No. 4,088,250; U.S. Pat. No. 4,441,640; and U.S. Pat. No. 5,176,302.

While these devices fulfill their respective, particular objectives and requirements, the aforementioned patents do not disclose an insulating sleeve and beverage can holder for enclosing and supporting a beverage can residing within an insulating sleeve which includes a cylindrical container for receiving an insulating sleeve having a beverage can positioned therein, a lid movably mounted over an upper end of the container which can be closed to seal the beverage can within the container and reduce a loss of dissolved carbon dioxide from a beverage in the can, with belt clips and a mounting projection extending from the container for securing to a belt or other support surface.

In these respects, the insulating sleeve and beverage can holder according to the present invention substantially departs from the conventional concepts and designs of the prior art, and in so doing provides an apparatus primarily developed for the purpose of enclosing and supporting a beverage can residing within an insulating sleeve.

SUMMARY OF THE INVENTION

In view of the foregoing disadvantages inherent in the known types of container support structures now present in the prior art, the present invention provides a new insulating sleeve and beverage can holder construction wherein the same can be utilized for enclosing and supporting a beverage can residing within an insulating sleeve. As such, the general purpose of the present invention, which will be described subsequently in greater detail, is to provide a new insulating sleeve and beverage can holder apparatus and method which has many of the advantages of the container support structures mentioned heretofore and many novel features that result in an insulating sleeve and beverage can holder which is not anticipated, rendered obvious, suggested, or even implied by any of the prior art container support structures, either alone or in any combination thereof.

To attain this, the present invention generally comprises a holder for enclosing and supporting a beverage can residing within an insulating sleeve. The inventive device includes a cylindrical container for receiving an insulating sleeve having a beverage can positioned therein. A lid is movably mounted over an upper end of the container and can be closed to seal the beverage can within the container and reduce a loss of dissolved carbon dioxide from a beverage in the can. Belt clips and a mounting projection extend from the container for securing to a belt or other support surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new insulating sleeve and beverage can holder apparatus and method which has many of the advantages of the container support structures mentioned heretofore and many novel features that result in an insulating sleeve and beverage can holder which is not anticipated, rendered obvious, suggested, or even implied by any of the prior art tool guides, either alone or in any combination thereof.

It is another object of the present invention to provide a new insulating sleeve and beverage can holder which may be easily and efficiently manufactured and marketed.

It is a further object of the present invention to provide a new insulating sleeve and beverage can holder which is of a durable and reliable construction.

An even further object of the present invention is to provide a new insulating sleeve and beverage can holder which is susceptible of a low cost of manufacture with regard to both materials and labor, and which accordingly is then susceptible of low prices of sale to the consuming public, thereby making such insulating sleeve and beverage can holders economically available to the buying public.

Still yet another object of the present invention is to provide a new insulating sleeve and beverage can holder which provides in the apparatuses and methods of the prior art some of the advantages thereof, while simultaneously overcoming some of the disadvantages normally associated therewith.

Still another object of the present invention is to provide a new insulating sleeve and beverage can holder for enclosing and supporting a beverage can residing within an insulating sleeve.

Yet another object of the present invention is to provide a new insulating sleeve and beverage can holder which includes a cylindrical container for receiving an insulating sleeve having a beverage can positioned therein, a lid movably mounted over an upper end of the container which can be closed to seal the beverage can within the container and reduce a loss of dissolved carbon dioxide from a beverage in the can, with belt clips and a mounting projection extending from the container for securing to a belt or other support surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
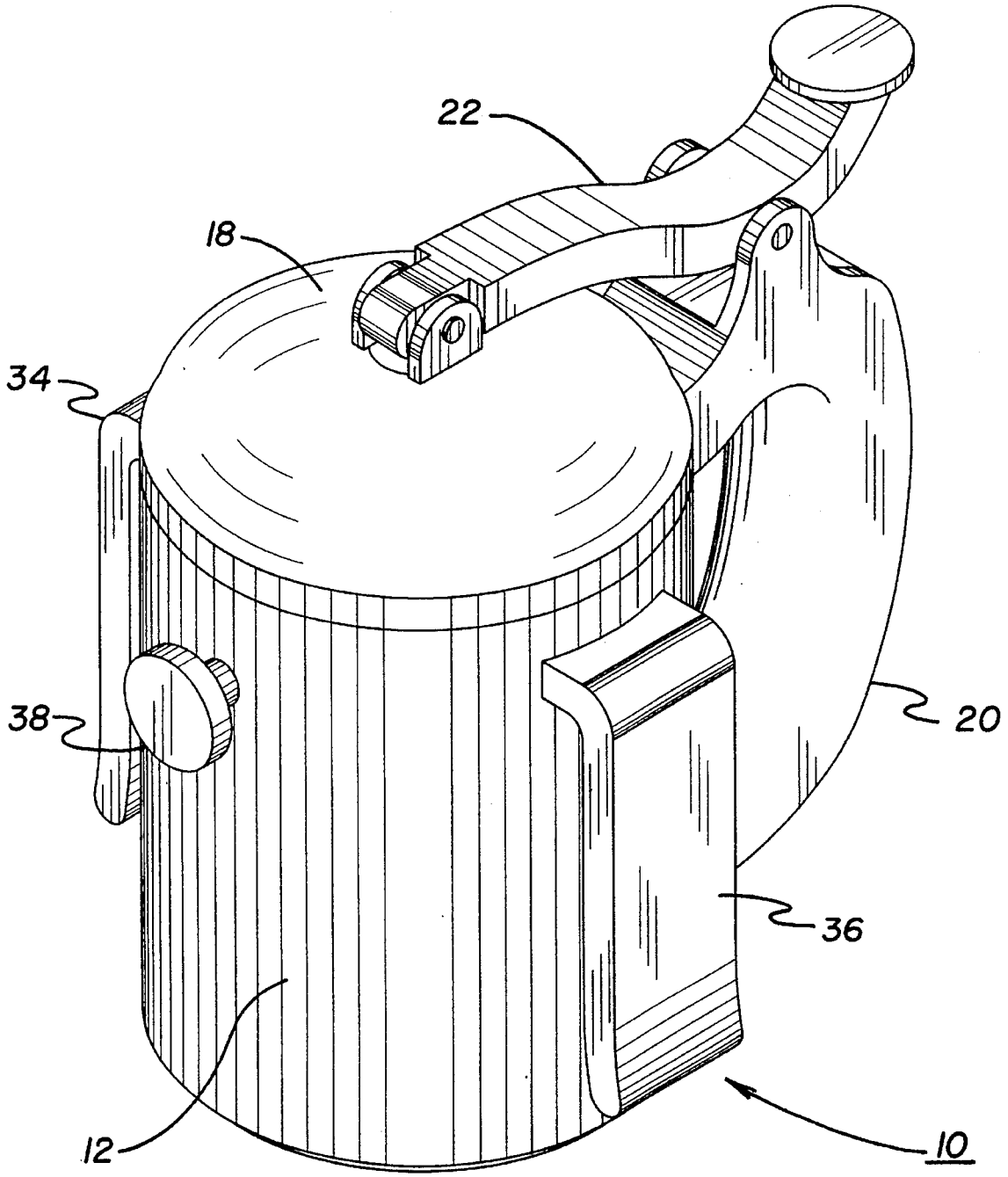
FIG. 1 is an isometric illustration of an insulating sleeve and beverage can holder according to the present invention.

With reference now to the drawings, and in particular to FIGS. 1–9 thereof, a new insulating sleeve and beverage can holder embodying the principles and concepts of the present invention and generally designated by the reference numeral 10 will be described.

Figure 5:
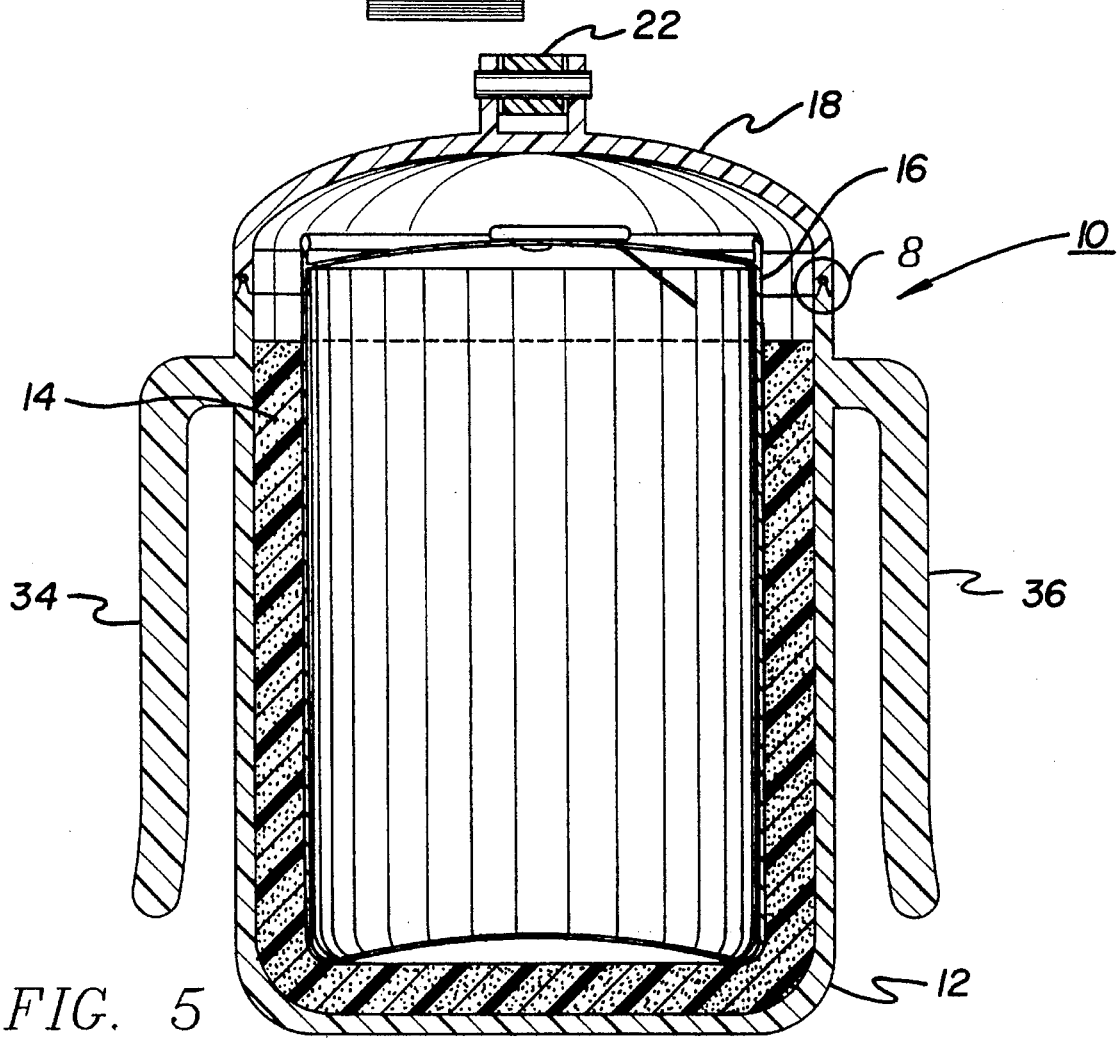
FIG. 5 is a cross-sectional view of the present invention.

More specifically, it will be noted that the insulating sleeve and beverage can holder 10 comprises a cylindrical container 12 having a closed lower end and an open upper end substantially as shown in FIG. 5 of the drawings. The cylindrical container 12 is adapted to receive a removable insulating sleeve 14 having a conventionally known twelve ounce beverage can 16 positioned within the insulating sleeve. A lid 18 is movably mounted relative to the open upper end of the cylindrical container 12 and can be selectively pivoted away therefrom to facilitate access to the beverage can 16 when positioned within the present invention 10 as shown in FIG. 5 of the drawings. By this structure, the present invention 10 serves to support and enclose the beverage can 16 residing within the removable insulating sleeve 14, with the lid 18 sealing the beverage can 16 therein so as to reduce a loss of dissolved carbon dioxide from a beverage present within the can.

Figure 2:
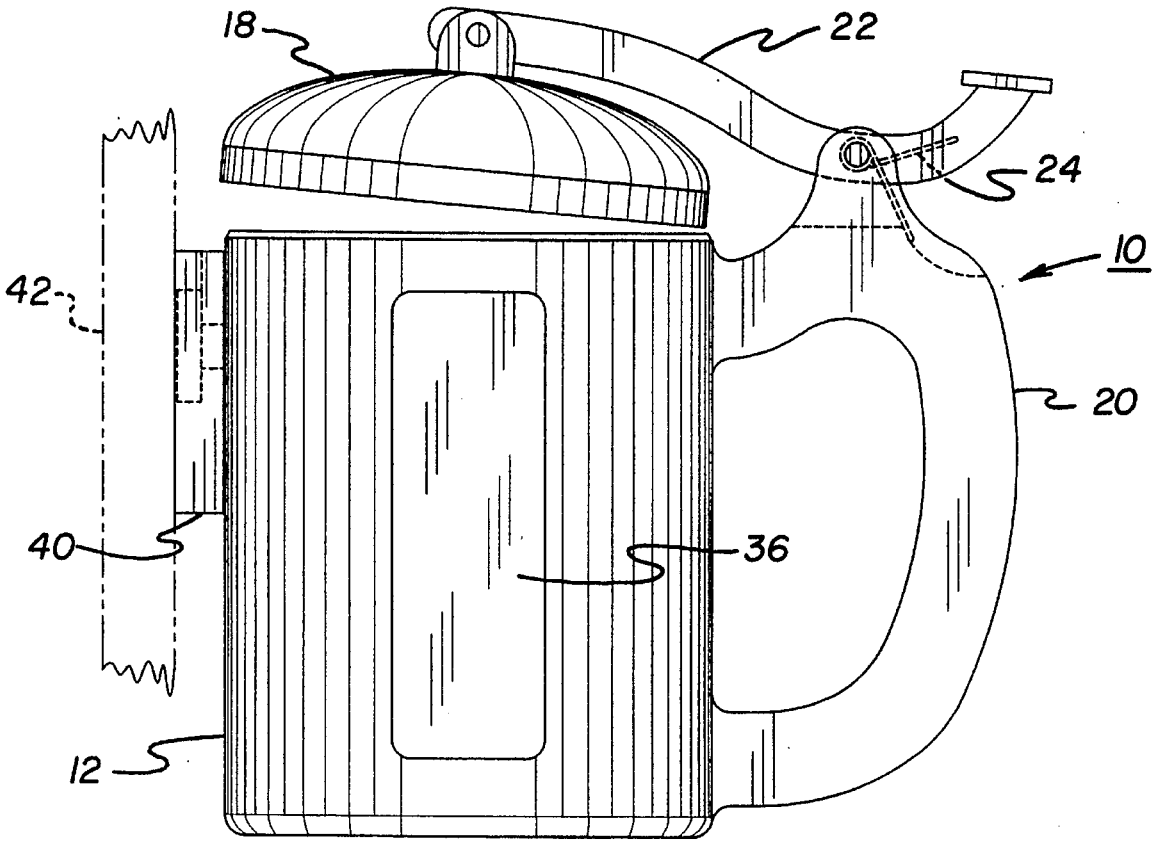
FIG. 2 is a side elevation view thereof.
Figure 3:
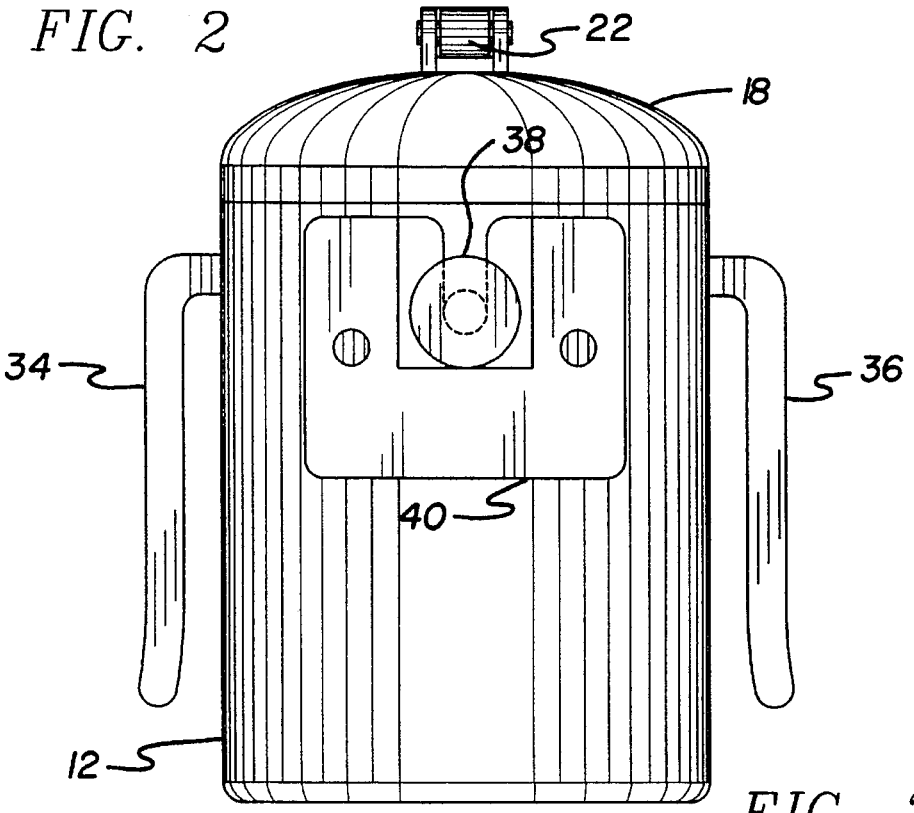
FIG. 3 is a front elevation view of the present invention.
Figure 9:
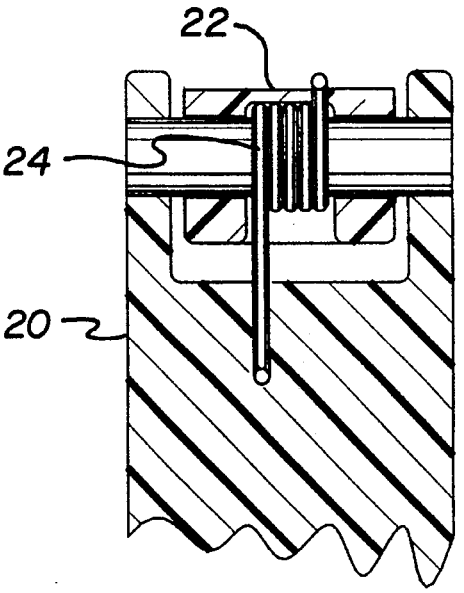
FIG. 9 is a cross-sectional view taken along line 9—9 of FIG. 4.

As shown in FIGS. 1 and 2, the present invention 10 further comprises a handle 20 mounted to an exterior surface of the cylindrical container 12. The handle 20 permits manual manipulation of the device 10 as desired by an end user. To movably mount the lid 18 over the open upper end of the cylindrical container 12, a thumb lever 22 is pivotally mounted to an upper end of the handle 20 and extends therefrom to pivotally couple with a center portion of the lid 18 substantially as shown in FIG. 1 of the drawings. The thumb lever 22 is pivotally mounted to the upper end of the handle 20 and extends beyond such pivotal mounting such that an individual depressing the thumb lever 22 can effect pivoting of the lid 18 away from the open upper end of the cylindrical container 12. To resiliently bias the lid 18 back into a closed configuration over the open upper end of the cylindrical container 12, a return spring 24 is interposed between the thumb lever 22 and the handle 20, as shown in FIGS. 2 and 9 of the drawings.

Figure 8:
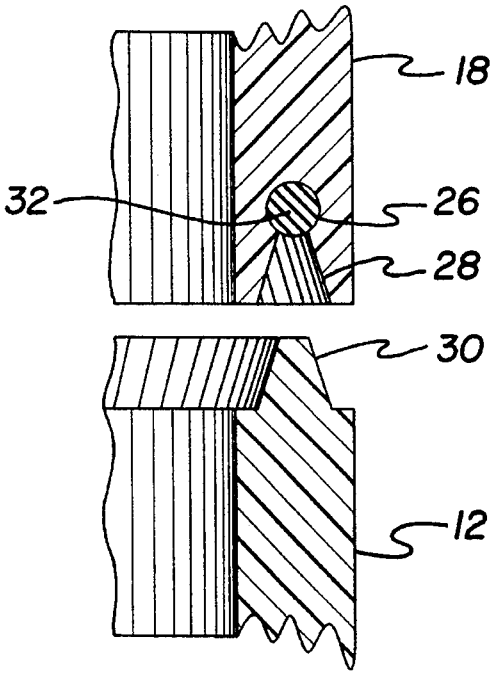
FIG. 8 is an enlarged cross-sectional view of the area set forth in FIG. 5.

Referring now to FIGS. 5 and 8, it can be shown that the lid 18 includes structure for sealingly engaging the open upper end of the cylindrical container 12. To this end, the lid 18 is shaped so as to define a circular annular bore 26 extending circumferentially through the lid and spaced from a lower annular end thereof. A tapered annular bore 28 extends from the lower annular end of the lid 18 and into contiguous communication with the circular annular bore 26. The tapered annular bore 28 is of a first transverse dimension at the lower annular end of the lid 18 and narrows to a second transverse dimension at a juncture of the tapered annular bore 28 and the circular annular bore 26, wherein the first transverse dimension is substantially greater than the second transverse dimension as shown in FIG. 8 of the drawings. The cylindrical container 12 is accordingly shaped so as to define a truncated tapered annular projection 30 projecting from an upper annular end of the cylindrical container which is cooperatively received within the tapered annular bore 28. A circular annular seal 32 is positioned within the circular annular bore 26 and abuttingly engages an upper planar annular surface of the truncated tapered annular projection 30 so as to create a substantial seal between the lid 18 and the cylindrical container 12 which reduces a loss of carbon dioxide from an effervescent beverage residing within the beverage can 16.

As shown in FIGS. 1 through 5, the present invention 10 includes various means for securing the cylindrical container 12 to a supporting surface such as a belt or a wall. To this end, a first belt clip 34 extends from an exterior surface of the cylindrical container 12 and is adapted to engage a belt or other object to support the present invention 10 relative thereto. A second belt clip 36 is mounted to a diametrically opposed side of the cylindrical container 12 and similarly operates to engage an object to support the present invention 10 relative thereto. The belt clips 34 and 36 are radially spaced from the handle 20 a distance of approximately ninety degrees so as to permit mounting of the device 10 to a belt with the handle 20 thereof projecting in a desired direction. Thus, the second belt clip 36 is not a redundant structure relative to the first belt clip 34, but rather permits the handle 20 to be positioned into a desired orientation when the device 10 is suspended from a belt loop so as to accommodate either a right-handed or left-handed individual.

Figure 4:
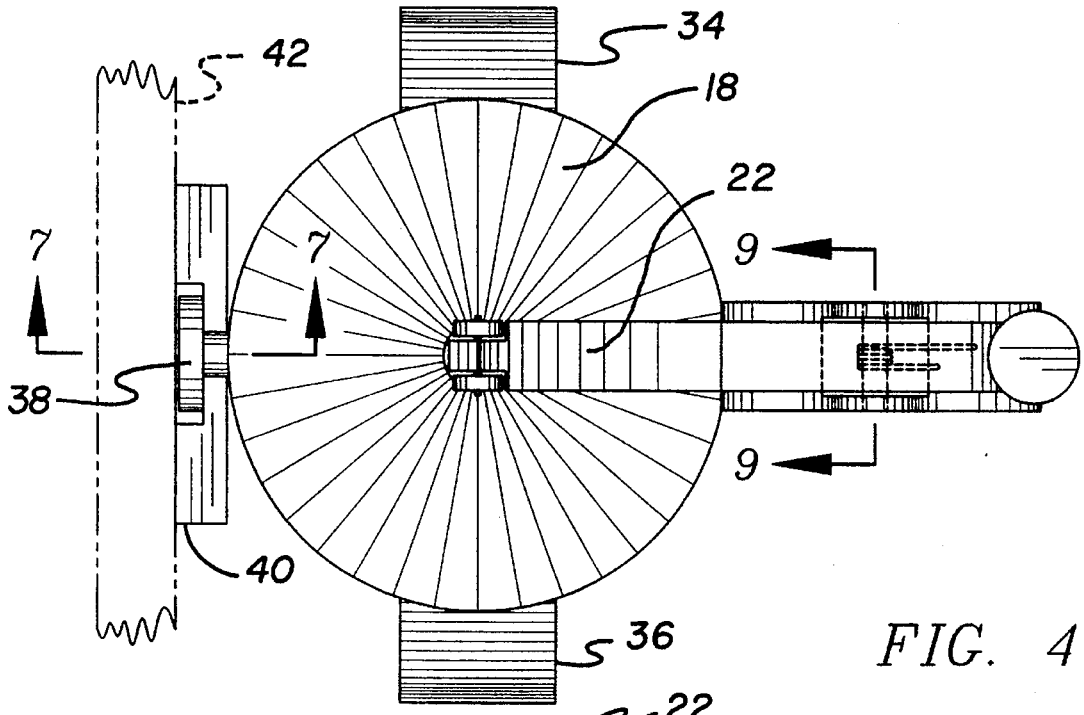
FIG. 4 is a top plan view thereof.
Figure 6:
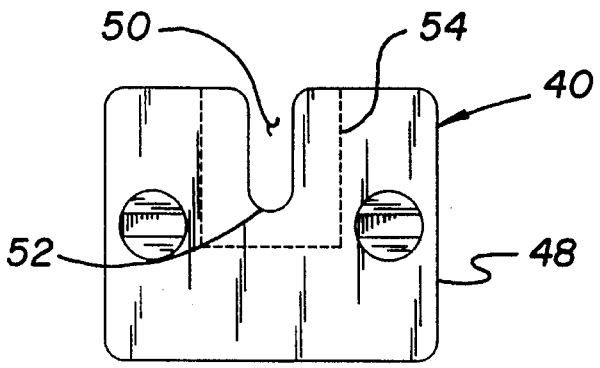
FIG. 6 is an elevation view of a mounting receiver of the invention.
Figure 7:
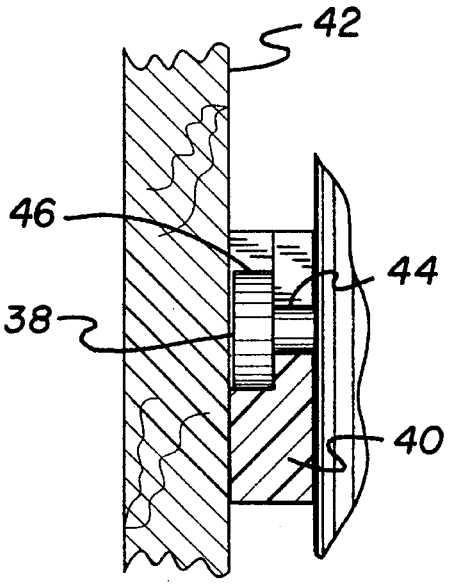
FIG. 7 is a cross-sectional view taken along line 7—7 of FIG. 4.

To facilitate mounting of the present invention 10 into a support surface such as a dashboard or a wall, a mounting projection 38 extends from the cylindrical container 12 and is preferably oriented in a diametrically opposed relationship relative to the handle 20. The mounting projection 38 is operable to be cooperatively received within a mounting receiver 40 securable to a support surface 42 such as a wall or a dashboard substantially as shown in FIG. 2 of the drawings so as to support the present invention 10 relative thereto. As shown in FIG. 7, the mounting projection 38 preferably comprises a projecting cylindrical member 44 having a first diameter extending from the cylindrical container 12 and terminating in an enlarged head 46 having a second diameter, wherein the second diameter is substantially greater than the first diameter as shown in FIG. 7. The mounting receiver 40, as shown in FIG. 6, comprises a rectangular plate 48 having a plurality of mounting apertures directed therethrough permitting securement of the mounting receiver 40 to a support surface via gilded fasteners or the like directed through the mounting apertures. The rectangular plate 48 is shaped so as to define a slot 50 directed vertically thereinto from an upper edge of the rectangular plate. The slot 50 terminates in a semi-circular end wall 52 against which the projected cylindrical member 44 abuttingly engages so as to permit pivoting of the mounting projection 38 relative to the mounting receiver 40 when the device 10 is suspended from a support surface 42 as shown in FIGS. 2 and 4 of the drawings. To accommodate the enlarged head 46 of the mounting projection 38, the rectangular plate 48 of the mounting receiver 40 is shaped so as to define an area of reduced thickness 54 within which the enlarged head 46 can be received as shown in FIGS. 6 and 7 of the drawings.

In use, the insulating sleeve and beverage can holder 10 of the present invention can be easily utilized for receiving and sealing a beverage can 16 residing within a removable insulating sleeve 14. Because the lid 18 is provided with a secured sealing engagement against the open upper end of the cylindrical container 12, carbonated beverages or the like residing within the beverage can 16 will pressurize a closed interior of the cylindrical container 12 to a point of equilibrium which precludes a further dissolution of carbon dioxide from the beverage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An insulating sleeve and beverage can holder comprising;

a cylindrical container having a closed lower end and an open upper end, the cylindrical container being adapted to receive a removable insulating sleeve having a beverage can positioned within the insulating sleeve;

a handle mounted to an exterior surface of the cylindrical container; and a lid movably mounted relative to the open upper end of the cylindrical container by a thumb lever pivotally mounted to an upper end of the handle, with a first end of the thumb lever extending from the handle and being pivotally coupled with a center portion of the lid, and a second end of the thumb lever extending from the handle for depression by an individual to effect pivoting of the lid away from the open upper end of the cylindrical container.

2. The insulating sleeve and beverage can holder of claim 1, and further comprising a return spring interposed between the thumb lever and the handle for resiliently biasing the lid into a closed configuration over the open upper end of the cylindrical container.

3. The insulating sleeve and beverage can holder of claim 2, wherein the lid is shaped so as to define a circular annular bore extending circumferentially through the lid and spaced from a lower annular end thereof, and a tapered annular bore extending from the lower annular end of the lid and into contiguous communication with the circular annular bore, the tapered annular bore being of a first transverse dimension at the lower annular end of the lid and narrowing to a second transverse dimension at a juncture of the tapered annular bore and the circular annular bore, wherein the first transverse dimension is substantially greater than the second transverse dimension; and further wherein the cylindrical container is shaped so as to define a truncated tapered annular projection projecting from an upper annular end of the cylindrical container which is cooperatively received within the tapered annular bore when the lid is positioned into a closed configuration over the open upper end of the cylindrical container; and further comprising a circular annular seal positioned within the circular annular bore which abuttingly engages an upper planar annular surface of the truncated tapered annular projection so as to create a substantial seal between the lid and the cylindrical container which reduces a loss of carbon dioxide from an effervescent beverage residing within the beverage can when the lid is positioned within the closed configuration.

4. The insulating sleeve and beverage can holder of claim 3, and further comprising a means for securing the cylindrical container to a supporting surface.

5. The insulating sleeve and beverage can holder of claim 4, wherein the means for securing the cylindrical container to a supporting surface comprises a first belt clip extending from an exterior surface of the cylindrical container and being adapted to engage a belt.

6. The insulating sleeve and beverage can holder of claim 5, wherein the means for securing the cylindrical container to a supporting surface further comprises a second belt clip mounted to a diametrically opposed side of the cylindrical container.

7. The insulating sleeve and beverage can holder of claim 6, wherein the belt clips are radially spaced from the handle so as to permit mounting of the can holder to a belt with the handle thereof projecting in one of two predetermined directions.

8. The insulating sleeve and beverage can holder of claim 7, wherein the means for securing the cylindrical container to a supporting surface further comprises a mounting projection extending from the cylindrical container and being oriented in a diametrically opposed relationship relative to the handle; and a mounting receiver securable to a vertical supporting surface, the mounting projection being received within the mounting receiver.

9. The insulating sleeve and beverage can holder of claim 8, wherein the mounting projection comprises a projecting cylindrical member having a first diameter and extending from the cylindrical container to terminate in an enlarged head having a second diameter, wherein the second diameter is substantially greater than the first diameter; and further wherein the mounting receiver comprises a rectangular plate having a plurality of mounting apertures directed therethrough, the rectangular plate being shaped so as to define a slot directed vertically thereinto from an upper edge of the rectangular plate, the rectangular plate further being shaped so as to define an area of reduced thickness within which the enlarged head is received.

10. The insulating sleeve and beverage can holder of claim 9, wherein the slot of the rectangular plate of the mounting receiver terminates in a semi-circular end wall against which the projected cylindrical member abuttingly engages so as to permit pivoting of the mounting projection relative to the mounting receiver.

11. The insulating sleeve and beverage can holder of claim 10, and further comprising a removable insulating sleeve having a beverage can positioned within the insulating sleeve, the removable insulating sleeve and the beverage can being positioned within the cylindrical container.

12. The insulating sleeve and beverage can holder of claim 1, and further comprising a removable insulating sleeve having a beverage can positioned within the insulating sleeve, the removable insulating sleeve and the beverage can being positioned within the cylindrical container.

13. The insulating sleeve and beverage can holder of claim 1, and further comprising means for securing the cylindrical container to a supporting surface.

14. The insulating sleeve and beverage can holder of claim 13, wherein the means for securing the cylindrical container to a supporting surface comprises a first belt clip extending from an exterior surface of the cylindrical container and being adapted to engage a belt.

15. The insulating sleeve and beverage can holder of claim 14, wherein the means for securing the cylindrical container to a supporting surface further comprises a second belt clip mounted to a diametrically opposed side of the cylindrical container.

16. The insulating sleeve and beverage can holder of claim 15, wherein the belt clips are radially spaced from the handle so as to permit mounting of the can holder to a belt with the handle thereof projecting in one of two predetermined directions.

17. The insulating sleeve and beverage can holder of claim 16, wherein the means for securing the cylindrical container to a supporting surface further comprises a mounting projection extending from the cylindrical container and being oriented in a diametrically opposed relationship relative to the handle; and a mounting receiver securable to a vertical supporting surface, the mounting projection being received within the mounting receiver.

18. The insulating sleeve and beverage can holder of claim 17, wherein the mounting projection comprises a projecting cylindrical member having a first diameter and extending from the cylindrical container to terminate in an enlarged head having a second diameter, wherein the second diameter is substantially greater than the first diameter; and further wherein the mounting receiver comprises a rectangular plate having a plurality of mounting apertures directed therethrough, the rectangular plate being shaped so as to define a slot directed vertically thereinto from an upper edge of the rectangular plate, the rectangular plate further being shaped so as to define an area of reduced thickness within which the enlarged head is received; and further wherein the slot of the rectangular plate of the mounting receiver terminates in a semi-circular end wall against which the projected cylindrical member abuttingly engages so as to permit pivoting of the mounting projection relative to the mounting receiver.

* * * * *